United States Patent [19]

Hara et al.

[11] 4,045,226

[45] Aug. 30, 1977

[54] IMAGE FORMING PROCESS BY COLOR INTENSIFICATION

[75] Inventors: Hiroshi Hara; Takushi Miyazako, both of Minami-ashigara, Japan

[73] Assignee: Fuji Photo Film Co., Ltd., Minami-ashigara, Japan

[21] Appl. No.: 705,990

[22] Filed: July 16, 1976

[30] Foreign Application Priority Data

July 17, 1975 Japan ..... 50-87484

[51] Int. Cl.[2] ..... G03C 5/32; G03C 1/72

[52] U.S. Cl. ..... 96/60 R; 96/22; 96/114

[58] Field of Search ..... 96/60 R, 55, 22, 114 R

[56] References Cited

U.S. PATENT DOCUMENTS

| | | | |
|---|---|---|---|
| 2,495,918 | 1/1950 | Bolton | 96/114 |
| 2,576,820 | 11/1951 | Barnes | 96/114 |
| 3,052,544 | 9/1962 | Dersch | 96/114 |
| 3,582,322 | 6/1971 | Edens et al. | 96/22 |
| 3,615,542 | 10/1971 | Oguchi et al. | 96/114 |
| 3,770,450 | 11/1973 | Kawano | 96/114 |
| 3,776,730 | 12/1973 | Matejec | 96/55 |
| 3,822,129 | 7/1974 | Dunn et al. | 96/22 |
| 3,923,513 | 12/1975 | Evans | 96/64 |
| 3,948,659 | 4/1976 | Yamaguchi et al. | 96/60 R |

*Primary Examiner*—Mary F. Kelley
*Attorney, Agent, or Firm*—Sughrue, Rothwell, Mion, Zinn and Macpeak

[57] ABSTRACT

An intensification processing in photographic processing for color photographic elements is effectively performed with less formation of fog by incorporating in at least one of the silver halide emulsion layers or in an auxiliary layer adjacent to a silver halide emulsion layer one or more compounds of the general formula $$-(A)_x-(B)_y-$$

wherein A represents $$-(CH_2-\underset{\underset{R}{|}}{CH})- \text{ or } -(CH_2-CH_2-O)-$$

wherein R represents

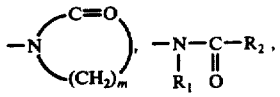

or —OH; $m$ represents an integer of 3 to 7; $R_1$ represents an alkyl group of 1 to 6 carbon atoms; and $R_2$ represents a hydrogen atom or an alkyl group of 1 to 4 carbon atoms; B represents a monomer unit from styrene, methacrylic acid ester, an acrylic acid ester, vinyl acetate, acrylonitrile, vinyl alcohol, vinyl chloride, vinyl ether, acrylamide, N,N-dimethylacrylamide, acrylic acid, methacrylic acid, maleic acid, potassium styrene sulfonate, an N,N-dialkylaminoalkyl methacrylate, vinyl imidazole, or vinyl pyridine; and $x$ and $y$ represent mole percent, the sum of $x$ and $y$ being 100 mole percent and $x$ being 30 mole percent or higher.

7 Claims, No Drawings

IMAGE FORMING PROCESS BY COLOR INTENSIFICATION

BACKGROUND OF THE INVENTION

1. Field of the Invention

The present invention relates to an image forming process by image intensification, in particular, to an image forming process which restrains the formation of fog in an intensification step, restrains the influence of intensification checking materials such as $I^-$ or $Br^-$ irons, and greatly improves the intensification effect. Even more specifically, the invention relates to an image forming process by intensification utilizing a photographic element having image forming unit layers each containing a sufficient amount of a color former having associated therewith a photosensitive silver halide in an amount less than the stoichiometrical amount thereof based on the amount of the color former.

2. Description of the Prior Art

Various processes have hitherto been known for intensifying the image formation of silver halide photographic materials by subjecting the photographic materials to development and intensification processings.

The formation of a dye by the oxidation of a p-phenylenediamine color developing agent caused by the decomposition of hydrogen peroxide on the surface of silver catalyst in the presence of a color former and the subsequent coupling of the oxidation product with the color former (this phenomenon is called "color intensification") is described in, for instance, Friedman; "History of Color Photography", 2nd Ed., 406(1956).

Furthermore, other various photographic processes wherein the decomposition of peroxides on the surfaces of noble metals is utilized are described in German Offenlegungusschrift Nos. 1,813,920; 1,950,102; 1,955,901; 1,961,029; 2,044,833; 2,044,993; 2,056,360; 2,056,359; and 2,120,091. Moreoever, it has long been known from old that peroxides are decomposed on the surfaces of noble metals as described in, for example, "Shokubai Kogaku Koza (Catalyst Industry)"; Vol. 2, published in 2966 by Chijin Shokan K.K.

On the other hand, color intensification processes by cobalt complex salts at the surfaces of noble metals are described in, for example, Japanese Patent Applications (Laid Open) Nos. 9728/'73; 9729/'73; 48130/'73; 84229/'74; 84239/'74; 84240/'74; 97614/'74; 102340/'74 and 102341/'74.

Also, color intensification processes by halogenous acid salts such as chlorites, etc., are described in, for example, Japanese Patent Applictions Nos. 128327/'74 and 139917/'74.

Compounds possessing an intensifying action, such as the above-indicated peroxides, halogenous acid salts, and cobalt(III) complex salts are called "intensifying agents" and a processing bath containing the intensifying agent is called an "intensifying bath" or "intensifier".

In the field of color photographic processing to which the process of this invention belongs, a color photographic material prepared by coating a support with silver halide emulsions containing cyan, yellow, and magneta color formers is image-wise exposed and then subjected to a series of photographic procedures for reproducing color images on the photographic material.

The fundamental steps of the processing are a color development step and a silver removal step. That is, in the color development step, the exposed silver halides in the silver halide color photographic material are reduced by a color developing agent to form silver images, and, at the same time, the color developing agent is oxidized. The oxidized color developing agent reacts with the color formers in the color photographic material to form dye images. Thereafter, the color photographic material is processed in the silver removal step to oxidize the silver formed in the previous step by the action of an oxidizing agent (called "a bleaching agent"). The color photographic material is then processed in a fix step, that is, the oxidized silver is dissolved by a complexing agent for silver ions (called a "fixing agent") and removed from the photographic material. Thus, the color photographic material processed in these steps has dye images only.

Generally, the development procedure further includes auxiliary steps for improving the photographic and physical qualities of the dye images formed and to improve the preservability of the color images in addition to the two fundamental steps of color development and silver removal. For example, as these auxiliary steps, there are illustrated the steps of hardening for preventing the photosensitive layers or films of the photographic material from being excessively softened during processing, stopping for effectively stopping the development reaction, image stabilization to stabilize the dye images formed, and a film removal bath for removing a backing layer formed on the support of the photographic material.

This kind of color photographic process as described above has been employed on a world wide basis in the color photographic field since 1940.

In the above-mentioned color intensification process, it is necessary to quickly carry out the oxidation of a reducing agent such as a color developing agent on the surface of a small amount of a metallic silver catalyst comprising developing nuclei of silver halide grains, and developing silver to obtain a dye density the same as in these conventional processes. For this purpose, it is desired to increase the activity of a processing bath containing the intensifying agent or to employ a reducing agent such as a color developing agent having a higher activity than conventional ones as is described in, for example, Japanese Patent Applications (Laid Open) 11534/'72 and 64932/'73.

When such a highly active intensification process is used, a photographic material using silver halide as the photosensitive material undergoes coloring even in unexposed portions in the intensification bath to form fog (referred to as color intensification fog), and this is a great problem in the case of the practical use of intensification processes.

While it might be concluded that the occurence of fog in the intensification step could be prevented by incorporating an antifoggant in the intensification bath, if an anti-foggant such as potassium bromide or sodium bromide is incorporated in the intensification bath, the intensifying action of the bath is also greatly suppressed. Further, the use of an organic anti-foggant possessing high adsorptive power (i.e., a compound having a mercapto group) greatly suppresses the intensifying power of the bath. On the other hand, an organic antifoggant possessing a weak adsorptive power (e.g., 6-nitrobenzimidazole) may be effectively used for this purpose, but if the amount of the compound is over 1 g/liter, the intensifying power of the bath is greatly suppressed.

Furthermore, an intensification bath containing a peroxide or halogenous acid salt as an intensifying agent is greatly degraded in intensifying activity by the presence of potassium bromide added to the developer as an antifoggant or by bromine ions or iodine ions released during the development of silver halide grains.

SUMMARY OF THE INVENTION

One object of this invention is, therefore, to provide an image forming process using color photographic materials suitable for image intensification processing.

Another object of this invention is to provide an image forming process which can be performed with less formation of color intensification fog, which is less influenced by intensification checking meaterials, and which has a high intensifying effect.

Still another object of this invention is to provide an image forming process for a silver conserving color photographic element having at least one image forming unit layer containing photosensitive silver halide in an amount less than the stoichiometric amount thereof (based on the color coupler) having associated therewith a sufficient amount of a color former, said image forming process being performed with less formation of color intensification fog, with less influence due to intensification checking materials, and with a high intensifying effect.

These objects of this invention are accomplished by an image forming process which comprises carrying out the intensification of the color images of a color photographic element comprising a support having coated thereon at least one photosensitive silver halide emulsion layer and, if desired or necessary, at least one auxiliary non-photosensitive layer, by treating the color photographic element wit at least one of a peroxide, a halogenous acid or a cobalt (III) complex salt as an intensifying agent in the presence of a reducing agent and, if desired or necessary, a color former, at least one of the photosensitive silver halide emulsion layer(s) and the auxiliary non-photosensitive layer(s) further containing a compound having a polymerization degree of 1 to 8,000 represented by the general formula $$-(A)_x-(B)_y-$$

wherein A represents

A. $-(CH_2-\underset{\underset{R}{|}}{CH})-$ wherein R represents

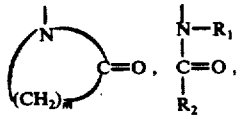

or —OH; $m$ represents an integer of 3 to 7; $R_1$ represents an alkyl group of 1 to 6 carbon atoms; and $R_2$ represents an alkyl group of 1 to 4 carbon atoms or a hydrogen atom; or b. $-(CH_2-CH_2-O)-$;

where B represents a monomer unit derived from styrene, methacrylic acid ester, an acrylic acid ester, vinyl acetate, acrylonitrile, vinyl alcohol vinyl chloride, vinyl ether, e.g., methyl vinyl ether, ethyl vinyl ether, phenyl vinyl ether, isobutyl vinyl ether, etc., acrylamide, N,N'— dimethlacrylamide, acrylic acid, methacrylic acid, maleic acid, potassium styrene sulfonate, an N,N-dialkylaminoalkyl methacrylate (in which each alkyl moiety has up to 6 carbon atoms) vinyl imidazole, or vinyl pyridine; where the sum of $x$ and $y$ is 100 mole percent and $x$ is equal to or greater than 30 mole percent, wherein $y$ may be 0 but need not be 0.

DESCRIPTION OF THE PREFERRED EMBODIMENTS

The most important feature of this invention lies in the point of incorporating the compound of the aforementioned general formula in at least one photosensitive silver halide emulsion layer and/or in at least one auxiliary non-photosensitive layer of a color photographic material which is subjected to intensification processing during color development. Specific examples of the compounds of the general formula are illustrated below, although the compounds of the general formula used in this invention are not limited to these compounds only.

(1)

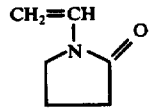

(2)

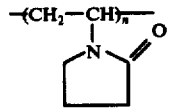

n: 100–150

(3)

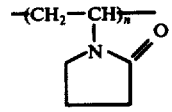

n: 300–500

(4)

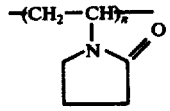

n: 2,000–3,000

(5)

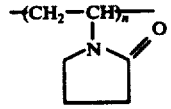

n: 5,000–8,000

(6)

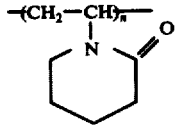

n: 2,000–3,000

(7)

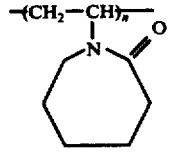

n: 300–500

-continued (8)

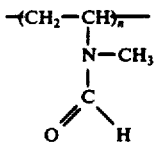

n: 2,000–3,000

(9)

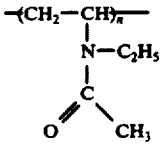

n: 2,000–3,000

(10)

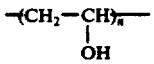

n: 10,000–25,000

(11)

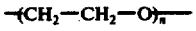

n: 5,000–8,000

(12)

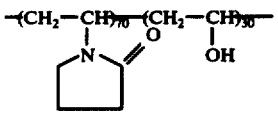

Molecular weight: 20,000

(13)

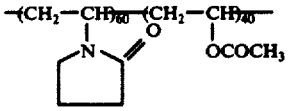

Molecular weight: 50,000

(14)

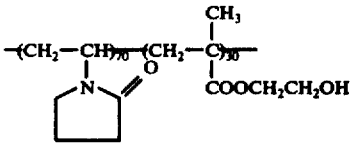

Molecular weight: 30,000

(15)

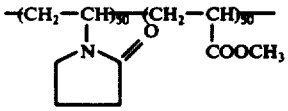

Molecular weight: 30,000

(16)

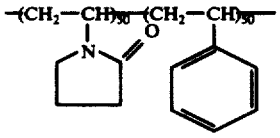

Molecular weight: 50,000

(17)

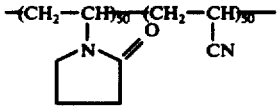

Molecular weight: 40,000

(18)

-continued

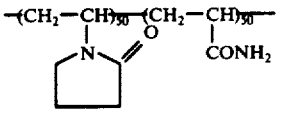

Molecular weight: 20,000

(19)

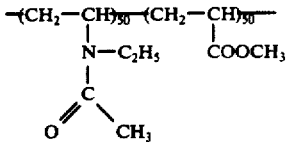

Molecular weight: 50,000

The compounds of the general formula used in this invention are described in, for example, U.S. Pat. Nos. 3,730,726; 3,770,450; 3,813,250; and 3,713,829 and German Pat. No. 1,772,074.

The peroxides used in this invention include organic peroxide compounds such as perbenzoates and inorganic peroxide compounds such as hydrogen peroxide, a peroxoborate, a peroxocarbonate, a peroxophosphate, a peroxosilicate, chlorine dioxide, etc.

The halogenous acids used in this invention chlorites not only chlorous acid and bromous acid but also chorites and bromites; they are described in Japanese Patent Application Nos. 128,327/'74 and 139,917/'74. Particularly preferred examples of the halogenous acids used in this invention are chlorous acid and chlorites of alkali metals such as lithium, sodium, potassium, etc., alkaline earth metals such as magnesium, calcium, strontium, barium, etc., and ammonium.

Furthermore, the cobalt (III) complex compounds used in this invention are cobalt complex compounds wherein the cobalt has a coordination number of 6. Examples of the liquid are ammine, ethylenediamine, diethylenetriamine, triethylenetetramine, nitrate, azide, nitrite, thiocyanate, isocyanate, water, and carbonate. In a preferred cobalt (III) complex compound in this invention, cobalt has at least 5 ammine ligands, at least 2 ethylenediamine ligands, or at least 1 triethylenetetramine ligand.

The pH of the intensification bath is in the range about of 7 to about 14, preferably in the range of 8 to 13. Examples of alkalizing agents, buffers, etc., used in the intensifier in this invention are sodium hydroxide, potassium hydroxide, sodium carbonate, potassium carbonate, sodium tertiary phosphate, potassium tertiary phosphate, potassium metaborate, and borax. They can be used individually or as any desired combination thereof.

The intensification bath used in this invention may further contain various salts such as disodium hydrogen phosphate, dipotassium hydrogen phosphate, potassium dihydrogen phosphate, sodium dihydrogen phosphate, sodium hydrogen carbonate, potassium hydrogen carbonate, an alkali borate, an alkali nitrate, and an alkali sulfate for imparting a buffer fuction, facilitating the preparation of the bath, or increasing the ionic strength thereof.

Furthermore, in the case of using the peroxide as the intensifying agent, the compounds described in W.C. Schumb et al; "Hydrogen Peroxide", pages 515–547, can be added to the stabilization bath as a stabilizer to improve stability of the peroxide.

Still further, the intensification bath used in this invention may contain a nitrogen-containing heterocyclic compound free of a mercapto group as an antifoggant, preferred examples of such heterocyclic compounds, are for example, the nitrobenzimidazoles described in U.S. Pat. No. 2,496,940; British Pat. No. 403,789; and U.S. Pat. Nos. 2,497,917 and 2,656,271; the benzotriazoles described in Nippon Shashin Gakkai Shi (Journal of The Society of Photographic Science and Technology of Japan), Vol. 11, 48(1948); heterocyclic quaternary salts such as the benzothiazoliums described in U.S. Pat. Nos. 2,131,038; 2,694,716; 3,326,681, etc.; the tetraazaindenes described in U.S. Pat. Nos. 2,444,605; 2,444,606; 2,444,607; etc.; and the heterocyclic compounds described in U.S. Pat. Nos. 2,173,628; 2,324,123; and 2,444,608. Other examples of such heterocylic compounds used for this purposes are also described in Kagaku Shahin Binran (Handbook of Scientific Photography), Vol. 2, page 119, published in 1959 by Maruzen K.K.

Moreover, if desired or necessary, a development accelerator may be added to the intensifier. Examples of the development accelerators used for this purpose are the pyridinium compounds described in U.S. Pat. Nos. 2,648,604; Japanese Patent Publication No. 9503/'69; and U.S. Pat. No. 3,671,247; cationic compounds, cationic dyes such as phenosafranine; neutral salts such as thallium nitrate and potassium nitrate; polyethylene glycol and the derivatives thereof as described in Japanese Patent Publication No. 9504/'69 and U.S. Pat. Nos. 2,533,990; 2,531,832; 2,950,970; and 2,577,127; nonionic compounds such as polythioethers; organic solvents and the organic amines as described in Japanese Patent Publication 9509/'69 and Belgian Pat. No. 682,862; the accelerators described in L. F. A. Mason, "Photographic Processing Chemistry" pages 40–43(1966) published by Focal Press, London; benzyl alcohol and phenylethyl alcohol as described in U.S. Pat. No. 2,515,147; and pyridine, ammonia, hydrazine, ammines, etc., as described in Nippon Shashin Gakkai Shi (Journal of The Society of Photographic Science and Technology of Japan), Vol 14, 74(1952).

Also, the intensifying bath used in this invention may further contain a sulfate or hydrochloride of hydroxylamine, sodium sulfite, potassium sulfite, potassium hydrogen sulfite, or sodium hydrogen sulfite.

Furthermore, polyphosphoric acid compounds such as sodium hexametaphosphate, sodium tetrapolyphosphate, sodium tripolyphosphate, and the potassium salts of the aforesaid polyphosphoric acids and also aminopolycarboxylic acids such as ethylenediaminetetraacetic acid, nitrotriacetic acid, cyclohexanediaminetetraacetic acid, iminoditriacetic acid, N-hydroxymethylethylenediaminetriacetic acid, diethylenetriaminepentaacetic acid, etc., may be used as a water softener in the intensification bath. The amount of the water softener depends upon the hardness of the water used but is usually about 0.5 to 1 g/liter. A masking agent such as calcium and magnesium may be also added to the intensification bath, if desired.

The reducing agent used in this invention is image-wise oxidized by the activated oxidizing agent formed by the change of the intensifying agent at the surface of exposed silver halide or developed silver catalyst. That is, it is a feature of an intensifying step to utilize the phenomenon that an intensifying agent used in the intensification step changes on the surface of the silver catalyst to exhibit a strong oxidative action.

A first example of the reducing agent used in this invention is a reducing agent which can be oxidized to form a dye by itself. A second example of the reducing agent is a reducing agent which is oxidized and oxidatively coupled with a color former (the coupler shown below) having a function of causing a coupling to form a dye. A third example of the reducing agent is a reducing agent which has a diffusible dye moiety but becomes non-diffusible by being image-wise oxidized. A fourth example of the reducing agent is a reducing agent which has a non-diffusible coupler moiety having a coupling function and is image-wise oxidized to release a diffusible coupler. In particular, a reducing agent which is oxidatively coupled with a coupler to form a dye is preferably used. In this case, however, the dye is formed only in the presence of the reducing agent and a coupler, and in other cases, dyes are formed from reducing agents only.

Examples of the reducing agent used in this invention are, for example, p-phenylenediamine color developing agents; the onium salt p-aminophenol derivative color developing agents described in U.S. Pat. No. 3,791,827; the dye developers described in U.S. Pat. No. 2,983,606; the diffusible dye releasing type redox compounds (DDR) described in Japanese Patent Application (Laid Open) No. 33826/'73; the developing agents capable of causing reaction with amidrazone compounds described in Japanese Patent Publication No. 39165/73; reducing agents of the type capable of causing oxidation to form dyes or lakes, such as tetrazonium salts, 2,4-diaminophenol, $\alpha$-nitroso-$\beta$-naphthol, leuco dyes, etc.; and the reducing agents which can form colored images by oxidation as described in Japanese Patent Application (Laid Open) No. 6338/'72, pages 9 to 13.

Examples of particularly preferred reducing agents used in this invention are the p-phenylenediamine color developing agents as described below and the onium salt p-aminophenol derivative color developing agents described in U.S. Pat. No. 3,791,827. These reducing agents form dyes only in the presence of couplers.

The reducing agent used in this invention may be incorporated in a processing solution and/or a color photographic material. The processing solution to which the reducing agent is added means a developer and/or an intensifier. In the case of incorporating the reducing agent into a color photographic material, the reducing agent may be incorporated in a silver halide photographic emulsion layer and/or an auxiliary non-photosensitive layer of the color photographic material, for example, a protective layer, an intermediate layer, or the like.

As indicated, particularly preferred reducing agents of this invention are p-phenylenediamine color developing agents and specific examples of such reducing agents are N,N-diethyl-p-phenylenediamines hydrochloride; 2-amino-5-diethylaminotoluene hydrochloride; 2-amino-5-(N-ethyl-N-laurylamino)toluene, 4-[N-ethyl-N-($\beta$-hydroxyethyl)amino]aniline sulfate; 2-methyl-4-[N-ethyl-N-($\beta$-hydroxyethyl)amino]aniline sulfate; N-ethyl-N-($\beta$-methanesulfoamidoethyl)-3-methyl-4-aminoaniline sesquisulfate monohydrate as described in U.S. Pat. No. 2,193,015; N-(2-amino-5-diethylaminophenylethyl)methanesulfonamide sulfate as described in U.S. Pat. No. 2,592,364; N,N-dimethyl-p-phenylenediamine hydrochloride; 4-amino-3-methyl-N-ethyl-N-methoxy-ethylaniline, 4-amino-3-methyl-N-ethyl-N-$\beta$-ethoxyethylaniline, 4-amino-3-methoxy-N-ethyl-N-$\beta$-butoxyethylaniline, and the salts (e.g., sulfates, hydrochlorides, sulfites, p-toluenesulfonates, etc.), thereof as described in U.S. Pat. Nos. 3,656,950 and 3,698,525.

Other examples of reducing agents are those where the reducing agent itself forms a dye image by oxidation and those where the reducing agent forms a complex salt with a metal salt. Such are described in British Pat. No. 1,210,417. The tetrazonium salts described in U.S. Pat. No. 3,655,382; and 2,4-diaminophenol, α-nitroso-β-naphthol, etc., can also be used.

The reducing agent is oxidized by the peroxide, the halogenous acid or the cobalt (III) complex salt in the presence of a catalyst material, but is oxidized at a very low rate of the oxidation reaction at areas where no catalyst exists. That is, the reducing agent itself is an image forming element or has the function of forming dye images by reaction of the oxidation product of the reducing agent with a color former or coupler.

A general photographic material contains 3 to 10 $g/m^2$ of silver salt as metallic silver and even a general print material contains 1 to 4 $g/m^2$ of silver. On the other hand, the content of silver in the color photographic materials of this invention is lower than about 5 $g/m^2$, in particular, lower than 3 $g/m^2$. Furthermore, in the case of a multilayer color photographic material, the silver content is less than about 2 $g/m^2$ per one photosensitive silver halide emulsion layer, in particular, in the range of from 1 $mg/m^2$ to 1 $g/m^2$.

The presence of a color former is necessary in this invention when dye images cannot be formed by only the oxidized reducing agent but not when the reducing agent is oxidized and forms a dye or dye images. That is, the color former used in this invention is a compound which can form a dye by coupling with the oxidation product of the reducing agent.

Preferred examples of the color former used in this invention are couplers, that is, compounds which form dyes by reaction with an oxidized color developing agent. Examples of the color formers used in this invention are, for example, couplers used for ordinary color photographic materials, such as open-chain ketomethylenic couplers, 5-pyrazolonic couplers, indazolonic couplers, and phenolic or naphtholic couplers; the diffusible dye releasing (DDR) couplers which release diffusible dyes by reaction with a color developing agent as described in British Pat. No. 840,731, U.S. Pat. No. 3,227,550, Japanese Patent Application (Laid Open) No. 123022/'74 and Japanese Patent Application No. 57040/'75; and the amidrazone compounds which release a diffusible dye by reaction with an oxidation product of a developing agent as described in Japanese Patent Publication No. 39165/'73.

In a typical example of this invention, the couplers are incorporated in photographic materials, and, in this case, the amount of coupler must be sufficient for giving the desired coupling density. Therefore, the amount of the coupler added is larger than the equimolar amount of silver. Examples of the couplers used in this invention are as follows.

Examples of useful yellow couplers are generally open-chain type ketomethylenic compounds as described in U.S. Pat. Nos. 3,341,331; 2,875,057; and 3,551,155; German Offenlegungsschrift No. 1,547,868; U.S. Pat. Nos. 3,265,506; 3,582,322; and 3,725,072; German Offenlegungsschrift No. 2,162,899; U.S. Pat. Nos. 3,369,895 and 3,408,194; and German Offenlegungsschrift No. 2,057,941; 2,213,461; 2,219,917; 2,261,361 and 2,263,875.

Examples of magenta couplers include the 5-pyrazolone compounds, cyanoacetyl compounds and indazolone compounds as described in U.S. Pat. Nos. 2,439,098; 2,600,788; 3,062,653; and 3,558,319; British Pat. No. 956,261; U.S. Pat Nos. 3,582,322; 3,615,506; 3,519,429; 3,311,476; and 3,419,391; Japanese Patent Applications Nos. 21454/'73 and 56050/'73; German Patent No. 1,810,464; Japanese Patent Publication No. 2016/'69; Japanese Patent Application No. 45971/'73 and U.S. Pat. No. 2,983,608.

Examples of useful cyano couplers are naphtholic derivatives as described in U.S. Pat. Nos. 2,369,929; 2,474,293; 2,698,794; 2,895,826; 3,311,476; 3,458,315; 3,560,212; 3,582,322; 3,591,383; 3,386,301; 2,434,272; 2,706,684; 3,034,892; and 3,583,971; German Offenlegungsschriften 2,163,811; Japanese Patent Publication 28836/'70 and Japanese Patent Application 33238/'73.

Furthermore, couplers which can release a development inhibitor upon coupling (DIR couplers) or compounds which release a development inihibiting compound upon coupling can be used in the color photographic materials. Examples of these couplers and compounds are described in, for example, U.S. Pat. Nos. 3,148,062; 3,227,554; 2,253,924; 3,617,291; 3,622,328; and 3,705,201; British Pat. No. 1,201,110; and U.S. Pat. Nos. 3,297,445; 3,379,529; and 3,639,417.

In the case of using the couplers illustrated above, two or more kinds of the couplers may be incorporated in one silver halide emulsion layer or the same kind of coupler may be incorporated in two or more emulsion layers to satisfy the characteristics desired in color photographic material.

The coupler incorporated in a unit layer of the color photograhic material to be processed by the process of this invention is a color coupler which is soluble in a coupler solvent (preferably a suitable polar coupler solvent) but insoluble in water. Typical examples of the useful solvents are tri-o-cresyl phosphate, trihexyl phosphae, dioctylbutyl phosphate, dibutyl phthalate, diethyl laurylamide, 2,4-diallylphenol, and liquid dye stabilizers as described in Product Licensing Index, Vol. 83, pages 26–29 (March 1971) under "Improved Type Photographic Dye Image Stabilizing Solvent". When the photograhic element contains a coupler solvent, it is believed that the solvent accelerates the absorption of a color developer in the case of transferring the photographic element from a developer bath to a sensitization bath.

It is convenient to select the photographic color couplers in such manner that they give intermediate scale images. That is, it is preferred that the maximum absorption band of the cyan dye formed from the cyan coupler be from about 600 mμ to about 720 mμ, the maximum absorption band of the magenta dye formed from the magenta coupler be from about 500 mμ to about 580 mμ, and the maximum absorption band formed from the yellow coupler be from about 400 mμ to about 480 mμ.

The silver halide emulsions used are usually prepared by mixing an aqueous solution of a water soluble silver salt such as silver nitrate and an aqueous solution of a water soluble halogen salt such as potassium bromide in the presence of an aqueous solution of a water soluble polymer such as gelatin. The silver halides used in this invention include silver chloride, silver bromide, silver chlorobromide, silver iodobromide, and silver chloroiodobromide. The form of these silver halide grains may be a cubic octahedral or a mixed crystal system, as desired.

The photographic silver halide emulsions used in this invention may be prepared by mixing two or more silver halide emulsions each prepared separately. Furthermore, the silver halide grains may have a uniform crystal structure throughout the grains, or may have different layer structure between the core and the shell of the grains, or further may be of the conversion type as described in British Pat. No. 635,841 and U.S. Pat. No. 3,622,318. Moreover, the silver halide may be of the type that a latent image is mainly formed at the surface thereof or may be of the internal latent image type where a latent image is mainly formed in the interior of the silver halide grains.

The photographic silver halide emulsion used in this invention may be prepared by an ammonia method, a neutral method, an acid method, etc., as described in Mees, "The Theory of the Photographic Process" published by MacMillan and P. Glafkides, "Chimie Photographique", published in 1957 by Paul Montel.

The afore-mentioned photographic silver halide emulsions may be chemically sensitized in any conventional manner, if desired. Examples of chemical sensitizers used for this purpose are the gold compounds such as chloroaurates, gold trichloride, etc., as described in U.S. Pat. Nos. 2,399,083; 2,540,085; 2,597,856; and 2.597,915; the salts of noble metals such as platinum, palladium, iridium, rhodium, and ruthenium as described in U.S. Pat. Nos. 2,448,060; 2,540,086; 2,566,245; 2,566,263; and 2,598,079; the sulfur compounds capable of forming silver sulfide by reaction with silver salts as described in U.S. Pat. Nos. 1,574,944; 2,410,689; 3,189,458; and 3,501,313; and stanous salts, amines, and other reducible materials as described in U.S. Pat. Nos. 2,487,850; 2,518,698, 2,521,925; 2,521,926; 2,694,637; 2,983,610; and 3,201,254.

It is preferred that the photographic element used in this invention further contain various additives for obtaining desired development characteristics, image properties, layer properties, etc. As such additives, there are iodides such as alkali metal iodides and organic compounds having a free mercapto radical such as pheylmercaoptotetrazole. It is desired, in such case, not to use excessively amounts thereof.

In general, an antifoggant is incorporated in the photosensitive silver halide emulsion layers and non-photosensitive auxiliary layers of the photographic elements, and preferred examples of the antifoggant are heterocyclic organic compounds such as tetrazoles, azaindenes, and triazoles.

The photographic element may further contain other additives known in the photographic arts such as a hardening agent, a plasticizer, a lubricant, a surface active agent, a brightener, etc.

Hydrophilic colloids are used for forming the photographic layers of the photographic elements used in this invention and examples of these hydrophilic colloids are gelatin, colloidal albumin, casein, cellulose derivatives such as carboxymethyl cellulose and hydroxyethyl cellulose, agar-agar, sodium alginate, and saccharose derivatives such as starch derivatives. If desired or necessary, two or mor kinds of these colloids which are compatible each other can be employed. Among these colloids, gelatin is most generally used, but a part or all of the gelatin may be replaced with a synthetic polymer. Furthermore, a gelatin derivative may be used.

The photographic silver halide emulsions may be, if desired or necessary, subjected to spectral sensitization or super-sensitization using cyanine dyes such as cyanine, merocyanine, carbocyanine, etc., dyes individually or as a mixture thereof or using a mixture of a cyanine dye and styryl dye, etc. Techniques for such sensitizations are known from old as described in U.S. Pat. Nos. 2,493,748; 2,519,001; 2,977,229; 3,480,434; 3,672,897; 3,703,377; 2,688,545; 2,912,329; 3,397,060; 3,615,635; 3,628,964; British Pat. Nos. 1,195,302; 1,242,588; and 1,293,862; German Offenlegungsschrifte Nos. 2,030,326 and 2,121,780; Japanese Patent Publications Nos. 4936/'68; 14030/'69; and 10773/'68; U.S. Pat. Nos. 3,511,664; 3,522,052; 3,526;641; 3,615,613; 3,615,632; 3,617,295; 3,635,721; and 3,694,217 and British Pat. Nos. 1,137,580; and 1,216,203. They can be properly selected according to the wave length regions, sensitivities, etc., to be sensitized, the purpose of the photographic elements, etc.

The photographic element used in this invention comprises a support having coated thereon at least one silver halide emulsion layer; usually it comprises a support having coated thereon at least a red-sensitive silver halide emulsion layer, a greensensitive silver halide emulsion layer, and a blue-sensitive silver halide emulsion layer.

In another embodiment, the photographic element used in this invention comprises a support having coated thereon at least a red-sensitive silver halide emulsion layer containing a cyan dye image forming coupler, a green-sensitive silver halide emulsion layer containing a magneta dye image forming coupler, and a blue-sensitive silver halide emulsion layer containing a yellow dye image forming coupler.

The photographic elements may further have non-photosensitive auxiliary layers such as an antihalation layer, an interlayer for preventing color mixing of the silver halide emulsion layers, a yellow filter layer, a protective layer, etc. The order of the photographic silver halide emulsion layers of the photosensitive element may be a red-sensitive layer, a green-sensitive layer, and a blue-sensitive layer, or a red-sensitive layer, a blue-sensitive layer, and a green-sensitive layer or further a blue-sensitive layer, a red-sensitive layer, and a green-sensitive layer or still further a red-sensitive layer, a green-sensitive layer, and a blue-sensitive layer (from the support side), although there is no particular limitation on the order of the emulsion layers.

Furthermore, the photographic element of this invention may have a layer structure such that at least one silver halide emulsion layer is composed of plural silver halide emulsion units as described in U.S. Pat. No. 3,726,681; British Pat. No. 923,045; U.S. Pat. No. 3,516,831; and Japanese Pat. Applications Nos. 5179/'75 and 42541/'75.

The photographic element used in his invention therefore usually comprises a support having coated thereon one or mor photosensitive silver halide emulsion layers and one or more non-photosensitive auxiliary layers. According to this invention, the compounds of the general formula earlier described, and, if desired or necessary, the reducing agent and/or the color former, are incorporated in at least one of these photographic layers. Moreover, if desired or necessary, the intensifying agent may be also incorporated in the photographic layer.

As supports for the photographic element, conventional materials are conveniently used, e.g., cellulose nitrate films, cellulose acetate films, cellulose acetate butyrate films, cellulose acetate propionate films, polystyrene films, polyethylene terephthalate films, polycarbonate films, laminates of these films, thin glass sheets, papers, etc. Baryta-coated papers, papers coated or laminated with a polymer such as an $\alpha$-olefin polymer obtained from a monomer having 2 to 10 atoms (in particular, polyethylene, polypropylene, an ethylene-butene copolymer, etc.) and a plastic film the surface of which has been matted to improve the adhesive property to other polymer layers as shown in Japanese Patent Publication No. 19068/'72 can also be used.

As such a support, a transparent support or an opaque support is used according to the purpose of the photographic element, and, as a transparent support, a colorless support as well as a tinted transparent support containing dyes or pigments can be used. Such a tinted support has been employed in the filed of X-ray films and is described in "J. SMPTE", 67, 296(1958).

Opaque supports for the photographic elements used in this invention include supports which are inherently opaque, such as papers, etc.; an opacified film prepared by incorporating a dye or a pigment such as titanium oxide in a transparent film, a plastic film surface treated as described in Japanese Patent Publication No. 19068/'72, and a paper or plastic film rendered completely shading by the addition of carbon black, dyes, etc.

When a support has an insufficient adhesive property to a photographic emulsion layer, a layer having good adhesion to both the support and the photographic emulsion layer is formed on the surface of the support as a subbing layer. Also, to further improve the adhesive property of the support, the surface of the support may be pretreated by a corona discharge, an ultraviolet irradiation, a flame treatment, etc.

The photographic element used in this invention is composed of a support having coated thereon at least one dye image forming unit layer as described above. A multi-color photographic element as is used in this invention is composed of a support having coated thereon at least two dye image forming unit layers each reproducing separate spectral colors. The unit layer contains a photosensitive silver salt, is spectrally sensitive to a specific spectral color, and is associated with a specific photographic color former. In a multilayer type color photographic element, the dye image forming unit layers thereof are preferably effectively separated from each other by a barrier layer, a spacer layer, a layer containing an agent capable of removing the oxidation products formed in development, or the like, for preventing the occurrence of color stains in the dye image forming unit layers. These techniques are known in the art and have been utilized for preventing the formation of color stains in many commercialized color photogrphic products. Also, the color photographic material used in this invention may have a layer preventing the occurence of development stains as is described in U.S. Pat. No. 3,737,317 and Japanese Patent Applications Nos. 73445/'73 and 113633/'73.

The photographic layers of the photographic element may be formed by coating coating compositions using dip coating, air knife coating, curtain coating, or hopper coating as described in U.S. Pat. No. 2,681,294. If desired, two or more photographic layers may be coated simultaneously in the manner described in U.S. Pat. Nos. 2,761,791; 3,508,947 and 3,837,095. Also, the color photographic element used in this invention may have a construction for color image transfer processes as described in U.S. Pat. Nos. 3,087,817, 3,185,567; 2,983,696; 3,253,915; 3,227,550; 3,227,551; 3,227,552; 3,145,633; 3,415,645; and 3,415,646 or for an absorption transfer process as described in U.S. Pat. No. 2,882,156.

When dye forming color formers or oxidation reduction dissociation type color formers are used in the photographic element, at least two color image forming unit layers contain these color formers in an amount of at least 40 percent larger than the stoichiometric amount of the color formers based on the amount of silver contained in the layers.

The developer used in this invention can contain, in addition to at least one of the afore-mentioned developing agents (reducing agents), an auxiliary developing agent such as N,N-tetramethyl p-phenylenediamine.

The developer may further contain conventional developer components such as those described above relative to the intensifier. Still further, the color developer used in this invention may contain, if desired or necessary, couplers such as citrazinic acid, J-acid, and H-acid as described in Japanese Patent Publications Nos. 9505/'69; 9506/'69; 9507/'69; 14036/'70; and 9508/'69; and in U.S. Pat. Nos. 2,742,832, 3,520,690; 3,560,212; and 3,645,737; fogging agents such as alkali metal borohydrides, amineborane, and ethylenediamine as described in Japanese Patent Publication No. 38816/'72; and compensating developers such as p-aminophenol, benzyl-p-aminophenol, 1-phenyl-3-pyrazolidone, etc., as described in Japanese Patent Publications Nos. 41475/'70; 19037/'71; and 19438/'71. The amount of the compensating developer employed in this case is preferably 0.01 to 1.0 g/liter.

Typical examples of color developers containing the various components as mentioned above are described in, for example, Kagaku Shashin Binran (Handbook of Scientific Photography), page 72, published in 1959 by Maruzen K.K.

In one typical photograhic process of this invention, the silver halide color photogrpahic material is developed, intensified, bleached, fixed, (or blixed in place of employing bleaching and fixing), washed, and dried to provide color images. A wash step may be employed between the intensification step and the bleach step or blix step, if desired.

In another embodiment of the photographic processes of this invention, a silver halide color photographic material containing a color developing agent in the silver halide emulsion layer or an auxiliary layer adjacent to the silver halide emulsion layer is processed in an intensification bath containing a peroxide, chlorite, chlorous acid and/or chlorine dioxide without being processed in a developer to perform development and intensification simultaneously, and, thereafter, bleached, fixed, (or blixed), washed and dried to provide color images.

In still another embodiment of the photographic processes of this invention, the silver halide color photographic material contains a color developing agent in the silver halide emulsion layer or an auxiliary layer adjacent thereto and is subjected to a mono-bath development, (that is, the material is processed in an intensification bath containing a fixing agent to perform development, intensification, and fixing simultaneously) and then rinsed and dried. As a modification of this embodiment, the development, intensification, and stabilization can be performed without any need for washing and rinsing.

In a further embodiment of the photographic process of this invention, couplers are incorporated in a color developer. Examples of diffusible couplers of the type used in this embodiment in a color developer are, for example, the cyan couplers described in U.S. Pat. Nos.

3,002,836 and 3,542,552; the magneta couplers described in Japanese Patent Publication No. 13111/'69; and the yellow couplers described in U.S. Pat. No. 3,510,306. In this case, the concentration of the coupler in the color developer is in a range of about 0.5 to about 5 g/liter, preferably 1-2.5 g/liter.

In another embodiment of the photographic process of this invention, a photosensitive emulsion layer is in a superposed relationship with an image-receiving layer and development is performed by spreading a developer between both layers, whereby dyes which became diffusible by oxidation with a chlorite, chlorous acid and/or chlorine dioxide diffuse into the image-receiving layer. As a modification of this embodiment, a diffusion transfer system wherein diffusible dyes diffuse into the image-receiving layer from the areas which were not oxidized can be used.

In a color photographic system, a substractive color type dye image can be formed by a color negative process as described in "Journal of the Society of Motion Picture and Television Engineers"; Vol. 61, 667-701(1953) by W. T. Hanson and W. I. Kesner, or by a color reversal process wherein a color photographic material prepared using a direct positive silver halide emulsion or a negative emulsion is image-wise exposed, developed in a black and white developer to form a negative silver image, exposed at least once (or subjected to a fogging), and, then, further developed to form a reversal silver image. In this case, a bleach step is generally employed after black and white development to prevent silver formed in the black and white development from becoming catalyst, and, further, an intensification is employed after the color development.

The processing temperature in the process of this invention is usually from about 10° C to about 70° C, in particular, from 20° C to 60° C.

The invention will now be illustrated more specifically by the following examples; however the embodiments of the present invention are not limited to these examples. Unless otherwise stated, percent is expressed by weight.

In addition, when the photographic element used in the examples was processed in an intensification bath containing a water-soluble chloride and a nitrogen-containing heterocyclic compound having an antifogging action and no mercapto group, together with a peroxide or chlorous acid or chlorite, or in an intensification bath containing a nitrogen-containing heterocyclic compound having an antifogging action and having no mercapto group and more than $1 \times 10^{-3}$ g/liter of bromine ions together with more than 0.2 mole/liter of a peroxide or a chlorite or chlorous acid, very good results were also obtained.

It is preferred that the compounds of the present invention having a polymerization degree of 1 to 800 used in an amount of about 1 mg to about 10 g, preferably 10 mg to 2 g/m² of support (summation of the total amount(s) in all layer(s) in which the compound(s) is/are present).

EXAMPLE 1

A color photographic element having the following construction was prepared:

SaMPLE A:

1. A paper support laminated with polyethylene having dispersed therein titanium dioxide.

2. A layer of a gelatino silver chlorobromide emulsion (bromine 80 mole%, Ag 100 mg/m²; gelatin 1000 mg/m²) containing 300 mg/m² of a coupler, α-pivaloyl-α-(2,4-dioxo-5,5'-dimethyloxazolidine-3-yl)-2-chloro-5-[α-(2,4-di-t-amylphenoxy)-butaneamido]-acetoanilide added thereto as a dispersion in tricresyl phosphate (300 mg/m² tricresyl phosphate), the emulsion layer being formed on the support.

3. A layer containing 1000 mg/m² of gelatin formed on layer (2).

The photographic element (sample A) thus prepared was sensitometrically exposed and subjected to the following processing.

| | | |
|---|---|---|
| Color development | 40° C | 1 min. |
| Intensification | 40° C | 1 min. |
| Wash | 25 to 40° C | 1 min. |
| Blix | 40° C | 1 min. |
| Wash | 25 to 40° C | 1.5 min. |

The compositions of the processing solutions used in the processings were as follows.

| | |
|---|---|
| Color developers: | |
| Benzyl alcohol | 15 ml |
| Sodium sulfite | 5 g |
| Potassium bromide | 0.5 g |
| Hydroxylamine sulfate | 3 g |
| 4-Amino-N-ethyl-N-(2-methoxyethyl)-m-toluidine-p-toluenesulfonate | 8 g |
| Sodium carbonate | 30.0 g |
| Diaminopropanol tetraacetate | 10.0 g |
| Water to make | 1000 ml |
| | pH 10.1 |
| Intensifier: | |
| $H_2O_2$ (30%) | 25 ml |
| $Na_2HPO_4 \cdot 12H_2O$ | 20 g |
| $Na_4P_2O_7 \cdot 10H_2O$ | 1 g |
| $Na_2SnO_3$ | 100 mg |
| NaOH | 0.5 g |
| 6-Nitrobenzotriazole | 50 mg |
| Water to make | 1000 ml |
| | pH 10.1 |
| Blix solution: | |
| $(NH_4)_2S_2O_3$ | 100 mg |
| $NH_4Fe(EDTA)$ | 51 g |
| EDTA | 3 g |
| $Na_2SO_3$ | 12 g |
| Water to make | 1000 ml |
| | pH 6.8 |

The results obtained are shown in Table 1.

In addition, $D_{0.3\ logE}{}^{1.0}$ in the table indicates the optical density (for evaluating gradation) on the characteristic curve increased by 0.3 logE to the high illumination side from an optical density of 1.0 (see Research Disclosure No. 11,660).

Sample B: The sample was prepared by the same procedure as for Sample A except that 50 mg/m² of Compound 7 shown before was incorporated in layer (2).

Sample C: The sample was prepared by the same manner aS for Sample A except that 100 mg/m² of Compound 7 was incorporated in layer (3).

The samples were sensitometrically exposed as in the case of Sample A and subjected to the same processings as above. The results are also shown in Table 1.

Table 1

| | Sample A | Sample B. | Sample C |
|---|---|---|---|
| $D_{min}$ | 0.30 | 0.15 | 0.18 |
| $D_{0.3}{}^{1.0\ logE}$ | 180 | 2.00 | 1.90 |

The results in Table 1 show that in the case of applying the process of this invention (i.e., in the case of processing Sample B and Sample C), $D_{min}$ (fog) was greatly reduced and the intensification effect was also higher. Also, the results show that the above excellent effects were obtained when the compound of the general formula was incorporated in the silver halide emulsion layer or the non-photosensitive layer.

EXAMPLE 2

The following photographic elements were prepared.

Sample D:

1. A paper support laminated with polyethylene having dispersed therein titanium dioxide.

2. A layer of a gelatino silver chlorobromide emulsion (Ag 80 mg/m²; grain size 0.8 micron; 80 mol% Br) containing 800 mg/m² of a coupler, α-pivaloyl-α-(2,4-dioxo-5,5'-dimethylhydantoin-3-yl)-2-chloro-5-[α(2,4-di-t-amylphenoxy)butaneamido] acetanilide dispersed in 400 mg/m² of dioctylbutyl phosphate, said layer being formed on the support (1).

3. A layer containing 800 mg/m² of gelatin formed on layer (2).

Sample E: The layers were prepared by the same manner as for Sample D except that 20 mg/m² of Compound 3 was incorporated in layer (2).

Samples D and E were sensitometrically exposed and subjected to the following processings.

| | | |
|---|---|---|
| Color development | 40° C | 1 min. |
| Intensification | 40° C | 1.5 min. |
| Blix | 40° C | 1 min. |
| Wash | 25 to 40° C | 1.5 min. |

The compositions of the processing solutions used in the above processings were as follows:

| | |
|---|---|
| Color developer: | |
| Benzyl alcohol | 5 ml |
| Potassium sulfite | 4 g |
| Potassium bromide | 0.5 g |
| Hydroxylamine sulfate | 2.0 g |
| Potassium carbonate | 30 g |
| Ethylenediaminetetraacetic acid tetra-sodium salt | 5 g |
| 2-Amino-5-diethylaminotoluene hydrochloride | 5 g |
| Water to make | 1000 ml |
| Intensifier: | |
| $Co(NH_3)_6Cl_3$ | 10 g |
| Benzyl alcohol | 5 ml |
| Potassium carbonate | 7.5 g |
| Potassium sulfite | 2 g |
| Ethylenediaminetetraacetic acid tetrasodium salt | 10 g |
| Potassium hydroxide | 5 g |
| Water to make | 1,000 ml pH 10.0 |
| Blix solution: | |
| $Co(NH_3)_6Cl_3$ | 3 g |
| Glacial acetic acid | 20 ml |
| Ammonium thiosulfate (70%) | 130 ml |
| Sodium sulfite | 15 g |
| Ethylenediaminetetraacetic acid tetrasodium salt | 5 g |
| Water to make | 1,000 ml pH 4.0 |

The results of measurements on the dye images following procedure of Example 1 are shown in Table 2.

Table 2

| | Sample D | Sample E |
|---|---|---|
| $D_{min}$ | 0.30 | 0.15 |
| $D_{0.3}^{1.0/logE}$ | 1.50 | 1.45 |

The above results show that $D_{min}$ or fog formation was greatly reduced by the employment of the compound of the general formula (Compound 3), but, in this case, the contrast was slightly reduced. Although the contrast was slightly reduced, it will be understood that the addition of Compound 3 is very effective for the prevention of fog during photographic color processing, including intensification.

EXAMPLE 3

Low-silver type multilayer color photographic elements having the following layer structure containing a coupler were prepared using polyethylene coated paper supports.

Sample F: (The following layers are shown in order from the support)

1. Layer 1 (blue-sensitive emulsion layer): A layer of a gelatino silver chlorobromide emulsion (Br content of 80 mole%) containing a dispersion of a yellow coupler, α-pivaloyl-α-[2,4-dioxo-5,5'-dimethyloxazolidine-3-yl]-2-chloro-5-[α-(2,4-di-t-amylphenoxy)butaneamido]-acetanilide in dibutyl phosphate at a coverage of 100 mg/m² of silver, 1,200 mg/m² of gelatin, 300 mg/m² of the yellow coupler, and 150 mg/m² of the coupler solvent.

2. Layer 2 (interlayer): A layer of gelatin coated at a coverage of 1,000 mg/m² of gelatin.

3. Layer 3 (green-sensitive emulsion layer): A layer of a gelatino silver chlorobromide emulsion (Br content of 50 mole%) containing a dispersion of a magenta coupler, 1-(2,4,6-trichlorophenyl)-3-[2-chloro-5-tetradecaneamido]anilino-2-pyrazolino-5-one, in tricresyl phosphate at a coverage of 100 mg/m² of silver, 1,000 mg/m² of gelatin, 300 mg/m² of the magenta coupler, and 300 mg/m² of the coupler solvent.

4. Layer 4: A layer coated at a coverage of 1,200 mg/m² of gelatin and 1,000 mg/m² of an ultraviolet absorbent [2-(2-hydroxy-3-sec-butyl-5-t-butylphenyl)-benzotriazole].

5. Layer 5 (red-sensitive emulsion layer): A layer of a gelatino silver chlorobromide emulsion (B4 content of 50 mole%) containing a dispersion of a cyan coupler, 2-[α-(2,4-di-t-amylphenoxy)butaneamido-4,6-dichloro-5-methylphenol, in dibutyl phosphate coated at a coverage of 100 mg/m² of silver, 1,000 mg/m² of gelatin, 400 mg/m² of the cyan coupler, and 200 mg/m² of the coupler solvent.

6. Layer 6 (protective layer): A layer coated at a coverage of 1,000 mg/m² of gelatin.

Sample G: The sample had the same layer structure as Sample E except that layer 1 contained Compound 4 at a coverage of 100 mg/m².

Sample H: The sample had the same layer structure as Sample F except that Layer 3 contained Compound 4 at a coverage of 100 mg/m².

The samples were sensitometrically exposed and subjected to the following processing:

| | | |
|---|---|---|
| Color development | 40° C | 1 min |
| Intensification | 40° C | 1 min |
| Wash | 25 to 40° C | 1 min |
| Blix | 40° C | 1 min |
| Wash | 25 to 40° C | 1.5 min |

The compositions of the processing solutions used in the above processings were as follows.

| | |
|---|---|
| Color developer: | |
| Benzyl alcohol | 10 ml |
| Potassium sulfite | 4 g |

-continued

| | |
|---|---|
| Potassium bromide | 0.5 g |
| Hydroxylamine sulfate | 2.0 g |
| Potassium carbonate | 30.0 g |
| Sodium nitrilotriacetate | 2.0 g |
| 4-Amino-N-ethyl-N-(2-methoxyethyl)-m-toluidine-p-toluenesulfonic acid | 8.0 g |
| Potassium hydroxide | 1.2 g |
| Water to make | 1,000 ml |
| Intensifier: | |
| Sodium peroxoborate | 20 g |
| $H_2O_2$ (30%) | 20 ml |
| $Na_2HPO_4$ (anhydrous) | 10 g |
| $Na_4P_2O_7 . 10H_2O$ | 1 g |
| 5-Methylbenzotriazole | 200 ml |
| Water to make | 1,000 ml |
| Blix solution: | |
| Ethylenediaminetetraacetic acid tetra-sodium salt | 3 g |
| Glacial acetic acid | 20 ml |
| Ammonium thiosulfate (70%) | 130 ml |
| Sodium sulfite | 15 g |
| $Co(NH_3)_6Cl$ | 3 g |
| Water to make | 1,000 ml pH 4.3 |

The results of measurements on the color images following the procedure of Example 1 are shown in Table 3.

Table 3

| | | Sample F | Sample G | Sample H |
|---|---|---|---|---|
| $D_{min}$ | RL | 0.35 | 0.30 | 0.28 |
| | GL | 0.25 | 0.20 | 0.15 |
| | BL | 0.30 | 0.15 | 0.18 |
| $D_{0.3}^{1.0}$ logE | RL | 2.20 | 2.10 | 2.20 |
| | GL | 2.00 | 2.10 | 2.20 |
| | BL | 2.15 | 2.30 | 2.25 |

The above results show that by incorporating the compound of the general formula (Compound 4) in Layer 1 (blue-sensitive emulsion layer) of a multilayer color photographic material, the formation of fog was reduced in Layer 1 [the blue-sensitive emulsion layer (BL)] as well as in Layer 3 [the green-sensitive emulsion layer (GL)] and Layer 5 [the red-sensitive emulsion layer (RL)], and, further, the contrast of the blue-sensitive layer increased, that is, the intensification effect was increased.

When the compound of the general formula was incorporated in Layer 3 [the green-sensitive emulsion layer], the formation of fog was reduced in the green-sensitive emulsion layer as well as in the blue-sensitive emulsion layer (BL) and the red-sensitive emulsion layer (RL),

EXAMPLE 4

Multilayer color photographic materials having the same layer structures as Sample F, Sample G, and Sample H were prepared (also referred to as Sample F, Sample G, and Sample H, respectively, in this example). The samples were sensitometrically exposed and processed as in Example 3 except that an intensifier having the following composition was employed.

| | |
|---|---|
| Intensifier: | |
| Sodium peroxoborate | 20 g |
| $H_2O_2$ (30%) | 20 ml |
| $Na_2HPO_4$ | 10 g |
| $Na_4P_2O_7 . 10H_2O$ | 1 g |
| 5-Methylbenzotriazole | 200 mg |
| Potassium bromide | 400 mg |
| Water to make | 1,000 ml pH 10.0 |

Following measurement as in Example 1, the results are shown in Table 4.

Table 4

| | | Sample F | Sample G | Sample H |
|---|---|---|---|---|
| $D_{min}$ | RL | 0.15 | 0.10 | 0.10 |
| | GL | 0.15 | 0.10 | 0.09 |
| | BL | 0.18 | 0.12 | 0.12 |
| $D_{0.3}^{1.0}$ logE | RL | 1.80 | 1.95 | 1.95 |
| | GL | 1.22 | 1.90 | 2.00 |
| | BL | 1.60 | 1.95 | 1.90 |

The above results show that even if potassium bromide was present in the intensification bath (potassium bromide may be carried in the intensification bath from a color developer in practical color photographic processing), the reduction in the intensification effect by the catalytic neclei of potassium bromide was less in Sample G and Sample H, each containing the compound of the general formula (Compound 4).

EXAMPLE 5

Low-silver type multilayer color photographic materials having the following layer structure were prepared using papers of which both surfaces were coated with polyethylene having dispersed therein titanium oxide as the supports.

Sample I:

1. layer 1 (blue-sensitive emulsion layer): A layer of a silver chlorobromide emulsion (Br content of 70 mole%) containing a dispersion of a yellow coupler, α-pivaloyl-α-(2,4-dioxo-5,5'-dimethylhydantoin-3-yl)-2-chloro-5-[α-(2,4-di-t-amylphenoxy)butaneamido]-acetanilide, in dioctylbutyl phosphate coated at a coverage of 120 mg/m² of silver, 1,000 mg/m² of gelatin, 750 mg/m² of the yellow coupler, and 250 mg/m² of the coupler solvent.

2. Layer 2 (interlayer): A layer coated at a coverage of 800 mg/m² of gelatin and 50 mg/m² of dioctylhydroquinone.

3. Layer 3 (green-sensitive emulsion layer): A layer of a silver chlorobromide emulsion (Br content of 30 mole%) containing a dispersion of a magenta coupler, 1-(2,4,6-trichlorophenyl)-3-[2-chloro-5-tetradecaneamido]anilino-2-pyrazolino-5in tricresyl phosphate coated at a coverage of 90 mg/m² of silver, 600 mg/m² of gelatin, 350 mg/m² of the magenta coupler, and 175 mg/m² of the coupler solvent.

4. Layer 4: A layer coated at a coverage of 1,800 mg/m² of gelatin, 700 mg/m² of an ultraviolet absorbent [2-(2-hydroxy-3-sec-butyl-5-t-butylphenyl)benzotriazole], and 50 mg/m² of dioctylhydroquione.

5. Layer 5 (red-sensitive emulsion layer): A layer of a silver chlorobromide emulsion (Br content of 80 mole%) containing a dispersion of a cyan coupler, 2-(hexafluorobutylamido)-5-[α-(2,4-di-t-amylphenoxy)-butaneamido]-4-chlorophenol, in dibutyl phosphate coated at a coverage of 60 mg/m² of silver, 600 mg/m² of gelatin, 400 mg/m² of the cyan coupler, and 200 mg/m² of the coupler solvent.

6. Layer 6 (protective layer): A layer coated at a coverage of 1,000 mg/m² of gelatin.

Sample J: The sample had the same layer structure as Sample I except that Layer 1 contained Compound 12 at a coverage of 100 mg/.m².

The samples were sensitometrically exposed and subjected to the following processing.

| Processing A: | | |
|---|---|---|
| Color development | 40° C | 1 min |
| Intensification in Intensifier A | 40° C | 1 min |
| Wash | 25 to 40° C | 1 min |
| Blix | 40° C | 1 min |
| Wash | 25 to 40° C | 1.5 min |

Processing B: Intensifier A was in the above processing was replaced with Intensifier B.

The compositions of the processing solutions used in the above processing were as follows.

| Color developer: | | |
|---|---|---|
| Benzyl alcohol | | 15 ml |
| Sodium sulfite | | 5 g |
| Potassium bromide | | 0.4 g |
| Hydroxylamine sulfate | | 2.0 g |
| 4-Amino-3-methyl-N-ethyl-N-β-(methanesulfonamido)ethylaniline | | 10.0 g |
| Sodium Carbonate | | 30.0 g |
| Diethylenetriaminepentaacetic acid | | 5.0 g |
| Water to make | | 1000 ml pH 10.1 |
| Intensifier: | Intensifier A | Intensifier B |
| $H_2O_2$ (30%) | 30 ml | 30 ml |
| $Na_2HPO_4 \cdot 12H_2O$ | 20 g | 20 g |
| $Na_4P_2O_7 \cdot 10H_2O$ | 1 g | 1 g |
| $Na_2SnO_3$ | 0.1 g | 0.1 g |
| KBr | — | 0.3 g |
| 5-Nitrobenzimidazole | 0.2 g | 0.2 g |
| Water to make | 1,000 ml pH 10.1 | 1,000 ml pH 10.1 |
| Blix solution: | | |
| Ammonium thiosulfate (70%) | | 150 ml |
| $Na_2SO_3$ | | 5 g |
| Na[Fe(EDTA)] | | 40 g |
| EDTA | | 4 g |
| Water to make | | 1,000 ml pH 6.8 |

The results are shown in Table 5 following measurement as in Example 1.

Table 5

| | | Sample I | | Sample J | |
|---|---|---|---|---|---|
| | | (A) | (B) | (A) | (B) |
| $D_{min}$ | RL | 0.13 | 0.11 | 0.10 | 0.09 |
| | GL | 0.12 | 0.11 | 0.10 | 0.10 |
| | BL | 0.12 | 0.11 | 0.10 | 0.09 |
| $D_{0.3}^{1.0}$ logE | RL | 1.95 | 1.58 | 2.00 | 1.80 |
| | GL | 2.00 | 1.30 | 2.00 | 1.95 |
| | BL | 1.90 | 1.20 | 2.10 | 1.95 |

As is clear from the above results, in Sample J containing Compound 12, the fog density was low, the intensification effect was high, and the reduction in the intensifying function of the intensifier by the entrance of potassium bromide was greatly reduced.

While the invention has been described in detail and with reference to specific embodiments thereof, it will be apparent to one skilled in the art that various changes and modifications can be made therein without departing from the spirit and scope thereof.

What is claimed is:

1. A color image forming process for an image-wise exposed color photographic element comprising a support having coated thereon at least one photosensitive silver halide emulsion layer, and optionally at least one auxilliary non-photosensitive layer, including at least a color development and simultaneously or subsequent thereto an intensification, in the presence of a color former and a reducing agent which is oxidized and oxidatively coupled with the color former which comprises carrying out the intensification step in the presence of a peroxide intensifying agent and a compound having a polymerization degree of 1 to 8,000 represented by the following general formula in at least one of said photosensitive silver halide emulsion layer and said auxiliary non-photosensitive layer, if the latter layer is present;

$$-(A)_x-(B)_y-$$

wherein A represents

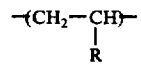

wherein R represents

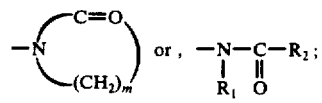

$R_1$ represents an alkyl group of 1 to 6 carbon atoms; $R^2$ represents a hydrogen atom or an alkyl group of 1 to 4 carbon atoms; and *m* represents an integer of 3 to 7; B represents a monomer unit induced from styrene, methacrylic acid ester, acrylic acid ester, vinyl acetate, acrylonitrile, vinyl alcohol, vinyl chloride, vinyl ether, acrylamide, N,N-dimethylacrylamide, acrylic acid, methacrylic acid, maleic acid, potassium styrene-sulfonate, N,N-dialkylaminoalkyl methacrylate, vinylimidazole or vinyl pyridine; and *x* and *y* represent mole percents; the sum of *x* and *y* being 100 mole percent and *x* being equal to or higher than 30 mole percent.

2. The color image forming process as set forth in claim 1 in which said peroxide is hydrogen peroxide, a peroxoborate, a peroxocarbonate, a peroxophosphate, a peroxosilicate, or chlorine dioxide.

3. The color image forming process as set forth in claim 1 in which said peroxide is an organic peroxy compound.

4. The color image forming process as set forth in claim 1 in which said reducing agent is a p-phenylenediamine derivative color developing agent.

5. The color image forming process as set forth in claim 1 in which said color former is a coupler capable of forming a dye by reaction with the oxidation product of a color developer.

6. The color image forming process as set forth in claim 1 in which said photosensitive silver halide emulsion layer contains an amount of a color former sufficient to provide a desired image density and silver halide in an amount of less than the stoichiometric amount of the silver halide, based on the amount of said color former.

7. The process of claim 1, wherein the process is a color negative process including at least a color development, an intensification, a bleaching and a fixing, or a blixing in place of employing bleaching and fixing, in sequence after exposing the color photographic element.

* * * * *